US005548979A

United States Patent [19]

Ryan et al.

[11] Patent Number: 5,548,979

[45] Date of Patent: Aug. 27, 1996

[54] HORIZONTAL AXIS CLOTHES WASHING MACHINE WITH TUB SUSPENSION

[75] Inventors: Kiernan F. Ryan, Niskyuna; Rok Sribar, Clifton Park; Sudhir D. Savkar, Schenectady, all of N.Y.

[73] Assignee: General Electric Company, Schenectady, N.Y.

[21] Appl. No.: 376,572

[22] Filed: Jan. 23, 1995

[51] Int. Cl.[6] ..... D06F 37/22

[52] U.S. Cl. ..... 68/23.2; 68/23.1; 248/638; 248/318; 248/562

[58] Field of Search ..... 68/23.3, 23.1, 68/23.2; 248/318, 562, 638

[56] References Cited

U.S. PATENT DOCUMENTS

| | | | |
|---|---|---|---|
| 2,463,801 | 3/1949 | Page | 68/23.2 |
| 2,984,094 | 5/1961 | Belaieff | 68/23.2 |
| 3,089,326 | 5/1963 | Belaieff | 68/23.2 |
| 3,114,705 | 12/1963 | Pribonic et al. | 68/23.1 |
| 5,080,204 | 1/1992 | Bauer et al. | 68/23.1 |
| 5,115,651 | 5/1992 | Nukaga et al. | 68/23.2 |
| 5,398,528 | 3/1995 | Johnston et al. . | |

FOREIGN PATENT DOCUMENTS

| | | | |
|---|---|---|---|
| 607678 | 12/1993 | European Pat. Off. . | |
| 1186413 | 1/1965 | Germany | 68/23.2 |
| 2008162 | 9/1970 | Germany | 68/23.2 |
| 2-161996 | 6/1990 | Japan | 68/23.2 |
| 4-312498 | 11/1992 | Japan | 68/23.1 |
| 988931 | 1/1983 | U.S.S.R. | 68/23.3 |
| 2138029 | 10/1984 | United Kingdom | 68/23.1 |

OTHER PUBLICATIONS

Concurrently filed U.S. Patent Application RD–24063, K. F. Ryan et al., entitled "Horizontal Axis Clothes Washing Machine With Balance Rings".

Concurrently filed U.S. Patent Application RD–24146, K. F. Ryan et al., entitled "Clothes Basket and Balance Ring Subassembly for a Horizontal Axis Clothes Washing Machine".

See "Background of the Invention" in present application.

*Primary Examiner*—Frankie L. Stinson

*Attorney, Agent, or Firm*—Douglas E. Erickson; Marvin Snyder

[57] ABSTRACT

A horizontal axis clothes washing machine. A rotatable clothes basket has a generally longitudinally extending and generally horizontally disposed axis of rotation. The clothes basket is rotatably attached to a generally surrounding first member (which is a tub). A second member (which is a cabinet) generally surrounds the tub. At least two spaced-apart tub suspension subassemblies each include a cylinder, a rod, a piston, and a spring. The cylinder is attached to one of the first and second members. The rod has a first end positioned within the cylinder and has a second end attached to the other of the first and second members. The piston is positioned within the cylinder and is attached to the first end of the rod. The spring is positioned within the cylinder between the first and second ends of the rod. Preferably, a pair of balance rings are attached to the clothes basket.

10 Claims, 6 Drawing Sheets

HORIZONTAL AXIS CLOTHES WASHING MACHINE WITH TUB SUSPENSION

BACKGROUND OF THE INVENTION

The present invention relates generally to clothes washing machines, preferably to clothes washing machines having a balance ring, and more particularly to a tub suspension for a horizontal axis clothes washing machine.

Conventional clothes washing machines include vertical axis clothes washing machines and horizontal axis clothes washing machines, where "vertical axis" and "horizontal axis" refer to the orientation of the axis of rotation of the clothes basket. The clothes basket is generally enclosed by, and rotatably attached to, the non-rotating tub, and the tub is generally enclosed by, and typically suspended from, the cabinet.

Conventional vertical axis clothes washing machines include those in which the tub is suspended from the cabinet by a rod and spring tub suspension subassembly which prevents the tub from striking the cabinet during washing. The subassembly includes a cylinder typically (pivotably) attached to the tub, a rod having a first end positioned within the cylinder and a second end (pivotably) attached to the cabinet, a piston positioned within the cylinder and attached to the first end of the rod, and a spring positioned within the cylinder between the first and second ends of the rod.

Conventional vertical axis clothes washing machines also include those having, a pair of balance rings with one balance ring being attached to the top and the other balance ring being attached to the bottom of the rotating clothes basket. The balance rings have circumferential cavities which are partially filled (typically between ten and ninety percent) with water, which are sealed, and which are independent of each other. The balance rings help balance an unbalanced load of clothes during the spin-dry cycle, as is known to those skilled in the art.

Known horizontal axis clothes washing machines lack balance rings and typically have the tub suspended by simple springs and damped from below by friction dampers or supported from below by shock absorber type struts. Such horizontal axis clothes washing machines tend to have their cabinet feet lift and tend to "walk" about during the spin-dry cycle, especially with a clothes-load unbalance, unless they are weighted or bolted down to the floor. Additionally, such horizontal axis clothes washing machines can transmit significant loads to the floor during the wash cycle. What is needed is a horizontal axis clothes washing machine which encompasses all of the following characteristics during both the wash and spin-dry cycles: small excursions; small bearing loads; small dynamic load transfer to the floor; and small weight.

SUMMARY OF THE INVENTION

It is an object of the invention to provide a horizontal axis clothes washing machine with improved stability (i.e., small clothes-basket transient and steady state excursions) during the spin-dry cycle and with reduced load transmission to the floor during the wash cycle.

The clothes washing machine of the invention includes a rotatable clothes basket, a first member, a second member, and at least two spaced-apart tub suspension subassemblies. The clothes basket has a generally longitudinally extending and generally horizontally oriented axis of rotation. The first member, which is a tub, has a generally longitudinally extending axis generally coaxially aligned with the axis of rotation. The tub generally surrounds the clothes basket, and the clothes basket is rotatably attached to the tub. The second member, which is a cabinet, generally surrounds the tub. Each tub suspension subassembly includes a cylinder, a rod, a piston, and a spring. The cylinder is attached to one of the first and second members. The rod has a first end positioned within the cylinder and has a second end attached to the other of the first and second members. The piston is positioned within the cylinder and is attached to the first end of the rod. The spring is positioned within the cylinder between the first and second ends of the rod.

In an exemplary embodiment of the invention, the clothes basket has two longitudinally spaced-apart ends, and the clothes washing machine also includes a pair of balance rings each attached to the clothes basket near a corresponding one of the two longitudinally spaced-apart ends of the clothes basket and each having a generally longitudinally extending axis generally coaxially aligned with the axis of rotation of the clothes basket.

Several benefits and advantages are derived from the invention. The rod and spring tub suspension subassembly provides a softer, more compliant, suspension which reduces the tendency of the horizontal axis clothes washing machine to "walk" about during the spin-dry cycle and which reduces the load transmission to the floor during the wash cycle. The pair of balance rings acts to further stabilize the horizontal axis clothes washing machine against a clothes-load unbalance during the spin-dry cycle.

BRIEF DESCRIPTION OF THE DRAWINGS

The accompanying drawings illustrate several preferred embodiments of the present invention wherein.

DETAILED DESCRIPTION OF THE INVENTION

Figure 1:
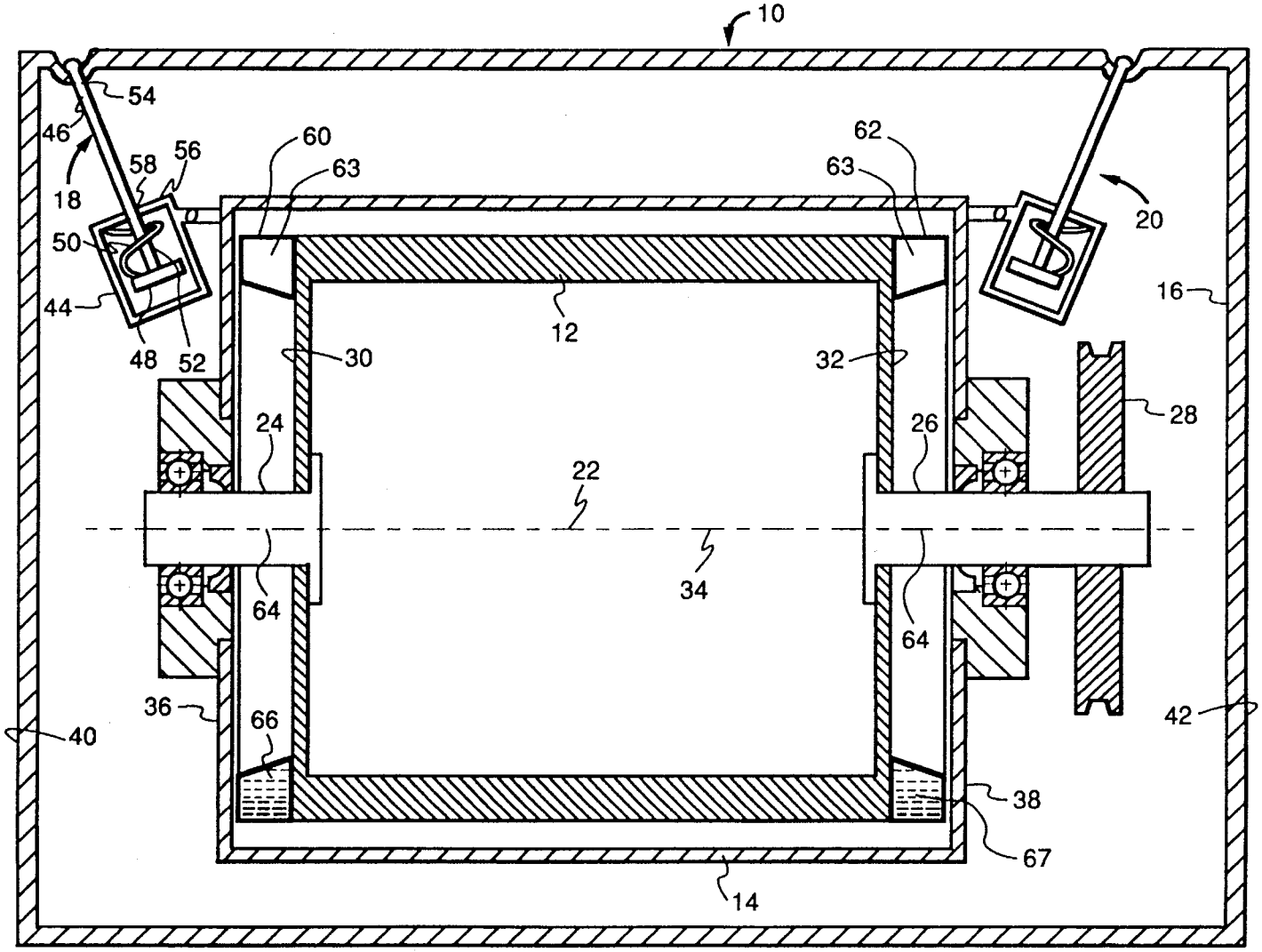
FIG. 1 is a schematic side-elevational view of a first preferred embodiment of the horizontal axis clothes washing machine of the invention showing two rod and spring tub suspension subassemblies and a pair of balance rings.

Referring now to the drawings, FIG. 1 shows a first preferred embodiment of the clothes washing machine 10 of the invention. The clothes washing machine 10 includes a rotatable clothes basket 12, a first member 14, a second member 16, and a plurality of spaced-apart tube suspension subassemblies 18, 20 (only two of which are shown in FIG. 1).

The clothes basket 12 has a generally longitudinally extending and generally horizontally disposed axis of rotation 22. Hence, the clothes washing machine 10 is referred to as a horizontal axis clothes washing machine. The clothes basket 12 rotates about end shafts 24 and 26 with end shaft 26 being turned by a pulley wheel 28 driven by a motor through a belt, such motor and belt drive being omitted from FIG. 1 for clarity. The clothes basket has two longitudinally spaced-apart ends 30 and 32.

The first member 14 is a tub having a generally longitudinally extending axis 34 generally coaxially aligned with the axis of rotation 22 of the clothes basket 12. The tub (first member) 14 generally surrounds the clothes basket 12, and the clothes basket 12 is rotatably attached to the tub 14. The tub 14 is non-rotating and has two longitudinally spaced-apart ends 36 and 38.

The second member 16 is a cabinet which generally surrounds the tub 14. The cabinet (second member) 16 has two longitudinally spaced-apart ends 40 and 42. Access to the clothes basket 12 to load and unload clothes preferably is from the top through a lid on the cabinet 16 and further through circumferential doors on the tub 14 and on the clothes basket 12, such access being conventionally known to those skilled in the art, not being a part of the present invention, and being omitted from FIG. 1 for clarity. An alternate preferred access to the clothes basket 12 is from the front through a door on the cabinet and further through open longitudinal ends of the tub 14 and the clothes basket 12, such alternate access not shown in the figures. It is noted that the clothes basket 12 has circumferential holes for water ingress and egress, such conventional holes being omitted from FIG. 1 for clarity.

The tub 14 is suspended from the cabinet 16 by the plurality of tub suspension subassemblies 18 and 20. Each tub suspension subassembly 18 and 20 includes a cylinder 44, a rod 46, a piston 48, and a spring 50. The cylinder 44 is attached (directly or indirectly) to one of the first and second members 14 and 16. The rod 46 has a first end 52 disposed within the cylinder 44 and has a second end 54 (directly or indirectly) attached to the other of the first and second members 14 and 16. The piston 48 is disposed within the cylinder 44 and is attached (directly or indirectly) to the first end 52 of the rod 46. The spring 50 is disposed within the cylinder 44 between the first and second ends 52 and 54 of the rod 46.

Preferably, the cylinder 44 is pivotably attached to the one member 14 (or 16), and the second end 54 of the rod 46 is pivotably attached to the other member 16 (or 14). It is preferred that such pivotal attachments be made by using conventional plastic cup designs. In an exemplary embodiment, the cylinder 44 includes an end 56 having an aperture 58 slidingly engaging the rod 46, and the cylinder 44 is pivotably attached to the one member 14 (or 16) proximate the end 56 of the cylinder 44. In a preferred embodiment, the second end 54 of the rod 46 of one 18 of the tub suspension subassemblies 18 and 20 is attached to the cabinet 16 proximate a corresponding one 40 of the two longitudinally spaced-apart ends 40 and 42 of the cabinet 16, and the first end 52 of the rod of the one tub suspension subassembly 18 is disposed proximate a corresponding one 36 of the two longitudinally spaced-apart ends 36 and 38 of the tub 14. Preferences for the exact number of the tub suspension subassemblies 18 and 20, the location of their attachment points to the tub 14 and cabinet 16, and the stiffness and other structural parameters of each cylinder 44, rod 46, piston 48, and spring 50 may be determined by computer simulation and/or experiment for a particular horizontal axis clothes washing machine 10, as is within the purview of those skilled in the art. Such preferences should be chosen to avoid exciting any natural frequencies. Likewise, the artisan may choose, in a particular application, to additionally connect the tub 14 to the bottom and/or sides of the cabinet 16 by various springs of other damping or attachment systems to reduce any initial transient during the spin-dry and wash cycles.

Computer simulations have shown that the tub suspension subassemblies 18 and 20 of the invention are "softer" (more compliant) than conventional tub suspension subassemblies for horizontal axis clothes washing machines resulting in improved stability with less tendency for the washing machine to "walk" about from a clothes-load unbalance during the spin-dry cycle when comparing machines of generally equal weight.

The clothes washing machine 10 preferably includes a pair of balance rings 60 and 62 each having a circumferential interior cavity 63, each attached to the clothes basket 12 proximate a corresponding one of the two longitudinally spaced-apart ends 30 and 32 of the clothes basket 12, and each having a generally longitudinally extending axis 64 generally coaxially aligned with the axis of rotation 22 of the clothes basket 12.

Preferably, a balancing material 66 and 67 is disposed in each of the cavities 63 of the balance rings 60 and 62 wherein the balancing material 66 is one of the balance rings 60 is sealed from the balancing material 67 in the other of the balancing rings 62. It is preferred that the balancing material 66 and 67 in each of the balance rings 60 and 62 is an identical liquid, and each of the cavities 63 of the balance rings 60 and 62 is filled between ten and ninety percent with the liquid. In an exemplary embodiment, the liquid is water, and one of the balance rings 60 is generally identical to the other of the balance rings 62. Other choices for the balancing material 66 and 67 includes, but is not limited to, small solid spheres of Teflon and the like, as can be appreciated by those skilled in the art.

Computer simulations have shown that the presence of the balance rings 60 and 62 results in improved stability of the horizontal axis clothes washing machine 10 with less tendency for the washing machine to "walk" about from a clothes-load unbalance during the spin-dry cycle. Smaller excursions of the clothes basket 12 and tub 14 reduce bearing loads as well as prevent the tub 14 from striking the cabinet 16. With a clothes-load unbalance during the spin-dry cycle, the physics of the system will cause the balancing material 66 and 67 to collect on the side of the balance rings 60 and 62 which is opposite to the unbalance mass. This will reduce the excursions of the clothes basket 12 which improves the transient and steady-state stability of the clothes washing machine 10.

As to be hereinafter described in detail, a second preferred embodiment of the clothes washing machine of the invention has the cavities of the balance rings in fluid communication with each other, and a third through fifth preferred embodiment each has the cavities of the balance rings in fluid communication with the clothes basket.

Figure 2:
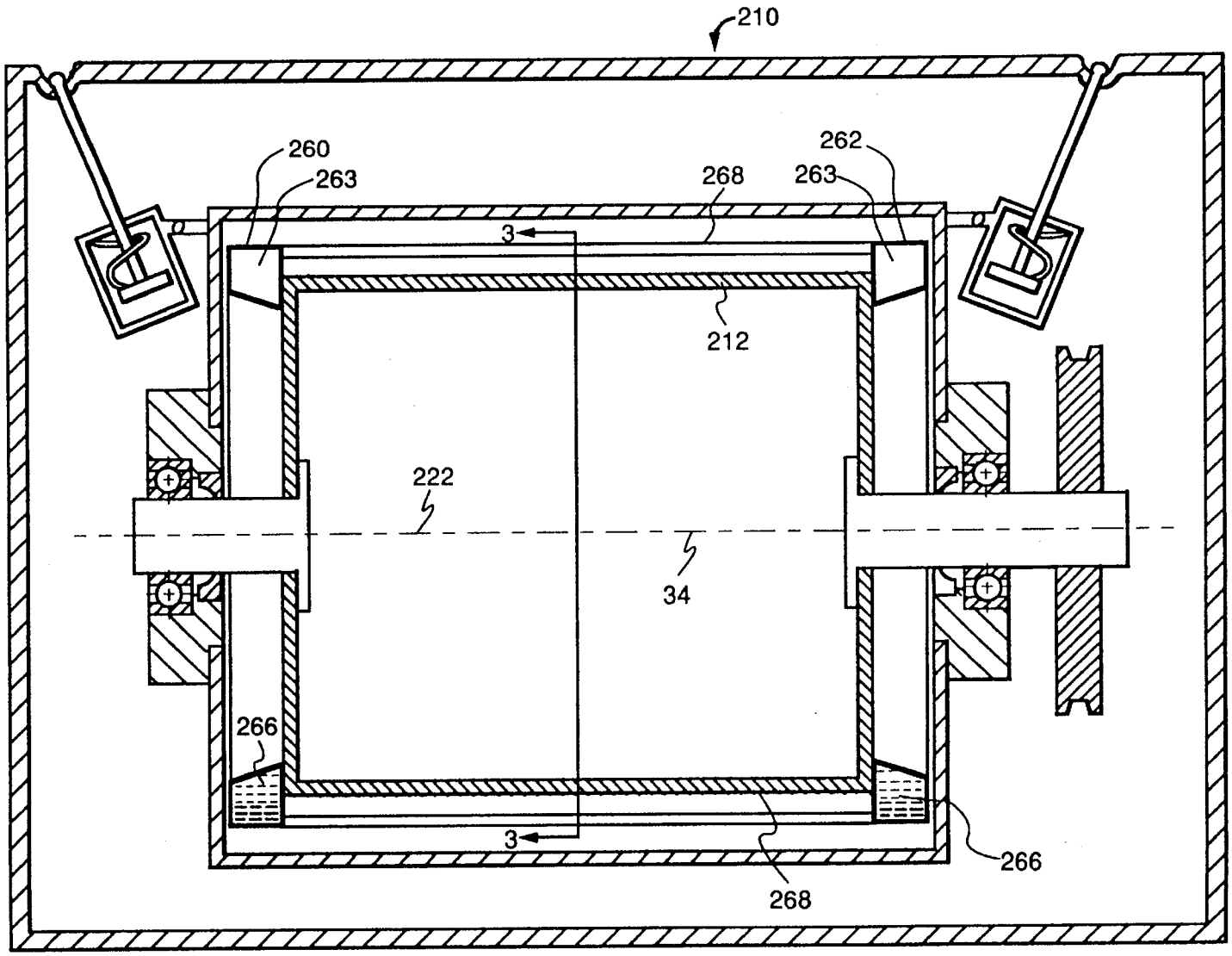
FIG. 2 is a schematic side-elevational view of a second preferred embodiment which is similar to that of FIG. 1 but adds tubes which connect the balance rings.
Figure 3:
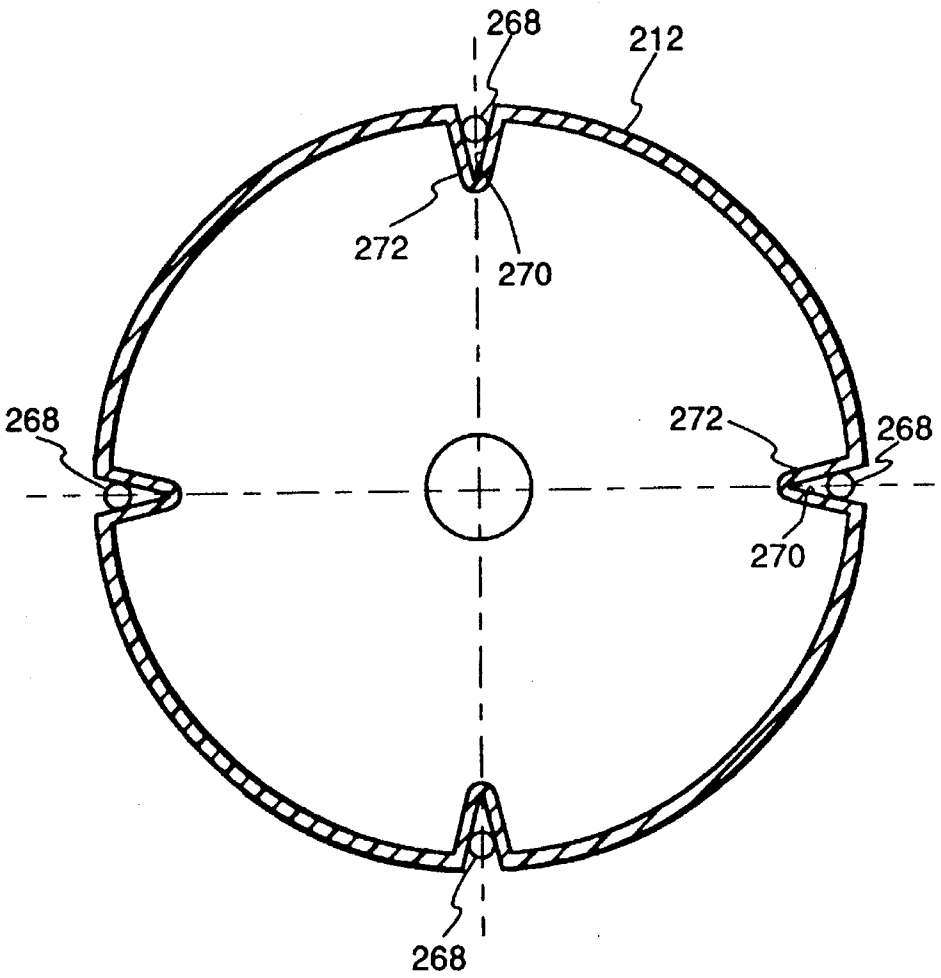
FIG. 3 is a sectional view of the washing machine of FIG. 2 taken along lines 3—3 of FIG. 2.

Referring again to the drawings, FIG. 2 shows the second preferred embodiment of the clothes washing machine 210 of the invention. The clothes washing machine 210 of FIG. 2 is generally identical to the clothes washing machine 10 of FIG. 1, but the clothes washing machine 210 of FIG. 2 also includes a plurality of tubes 268 connecting the cavity 263 of one of the balance rings 260 with the cavity 263 of the other of the balance rings 262 to define a balance system. The clothes washing machine 210 further includes a balancing material 266 disposed in the balance system wherein the balancing material 266 is movable between the balance rings 260 and 262 through the tubes 268. Preferably, the balancing material 266 is a liquid wherein the liquid in the balancing system would fill between ten and ninety percent of any one of the cavities 263 of the balance rings 260 and 262. In an exemplary embodiment, the liquid is water, and one of the balance rings 260 is generally identical to the other of the balance rings 262. In a preferred embodiment, the tubes 268 each are generally parallel to the axis of rotation 222 of the clothes basket 212. As seen in FIG. 3, preferably the clothes basket 212 has a multiplicity of generally longitudinally-extending exterior grooves 270, and each of the tubes 268 is disposed in a corresponding one of the exterior grooves 270. In a preferred construction, the exterior grooves 270 are defined by the radially outer surfaces of the clothes lifters 272 of the clothes basket 212.

Engineering analysis predicts that by having tubes 268 fluidly interconnect the cavities 263 of the balance rings 260 and 262, the horizontal axis clothes washing machine 210 is more stable than without such tubes 268 with less tendency for the washing machine to "walk" about from a clothes-load unbalance during the spin-dry cycle. With a clothes-load unbalance during the spin-dry cycle, the physics of the system will cause the balancing material 266 to move to the balance ring 260 or 262 undergoing the larger excursion and to collect on the side of that balance ring 260 or 262 which is opposite to the unbalance mass. This will reduce the excursion of the clothes basket 212 which improves the stability of the clothes washing machine 210. Having the balancing material 266 move through the tubes 268 to the particular balance ring 260 or 262 where it is needed will allow less total balancing material 266 to be used. This results in a reduction in the weight of the clothes washing machine 210.

The third through the fifth preferred embodiments of the clothes washing machine of the invention, to be discussed in detail in the following paragraphs, are generally identical to the first and second preferred embodiments shown in FIGS. 1 and 2 but with a different design for the balance rings and clothes basket which allows the cavities of the balance rings to be in fluid communication with the clothes basket. The balance rings and the clothes basket of each of the third through the fifth preferred embodiments are referred to together as a rotatable subassembly 374, 474, and 574, and are respectively shown in FIGS. 4 through 6. Engineering analysis predicts that by having the cavities of the balance rings be in fluid communication with the clothes basket, the horizontal axis clothes washing machine is more stable than without such fluid communication with less tendency for the washing machine to "walk" about from a clothes-lead unbalance during the spin-dry cycle. It is noted that the physics of balancing is similar to that for the washing machine 210 of FIG. 2. It is further noted that such fluid communication between the balance rings and the clothes basket in the third through the fifth embodiments allows the wash water to also act as the balancing material, with such wash water being basically present in the balance rings only during the spin-dry cycle, as can be appreciated by those skilled in the art. The absence of a permanent balancing material in the balance rings results in a weight reduction for the washing machine. Also, since the balance rings are nearly empty and hence have reduced inertia during the wash cycle, it will be easier to repeatedly reverse the direction of rotation of the clothes basket which is done to agitate the clothes; during the wash cycle.

Figure 4:
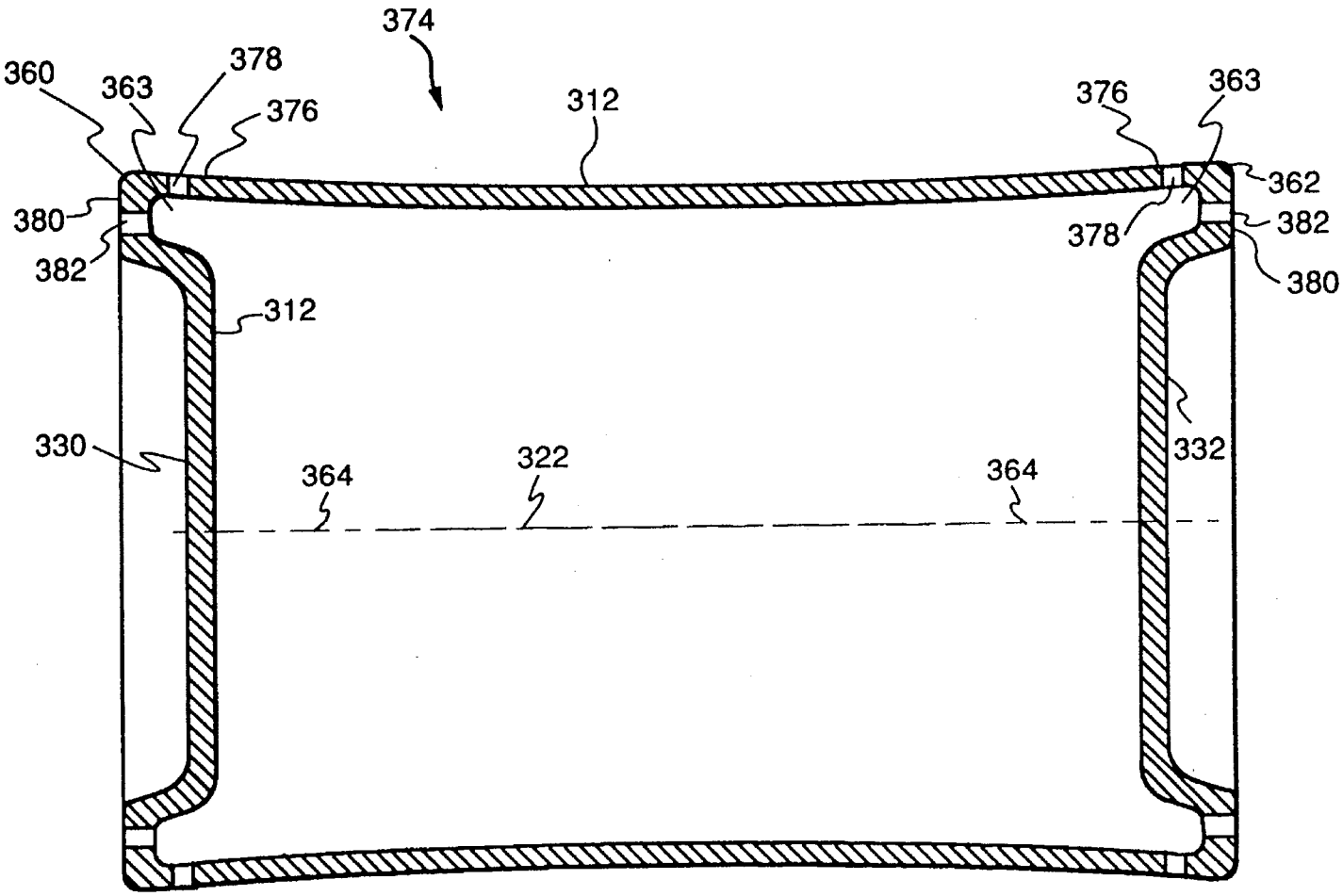
FIG. 4 is a schematic side-elevational view of a third preferred embodiment which shows only a rotatable subassembly which is similar to the clothes basket and balance ring portion of FIG. 1 but with the longitudinally-outwardly positioned balance ring completely open to the clothes basket.

FIG. 4, rotatable subassembly 374 includes a rotatable clothes basket 312 and a pair of balance rings 360 and 362. The clothes basket 312 has a generally longitudinally extending and horizontally disposed axis of rotation 322 and has two longitudinally spaced-apart ends 330 and 332. The balance rings 360 and 362 each have a circumferential interior cavity 363, each are attached to the clothes basket 312 proximate a corresponding one of the two longitudinally spaced-apart ends 330 and 332 of the clothes basket 312, and each has a generally longitudinally extending axis 364 generally coaxially aligned with the axis of rotation 322 of the clothes basket 312. The cavities 363 of the balance rings 360 and 362 are in fluid communication with the clothes basket 312. FIG. 4, the balance rings 360 and 362 each extend longitudinally-out, ward of the clothes basket 312, and the cavities 363 of the balance rings 360 and 362 each are completely longitudinally-inwardly open to the clothes basket 312. Preferably, the clothes basket 312 is flared radially outward toward the ends 330 and 332 proximate the balance rings 360 and 362 so that the wash water (i.e., the balancing material 366 flows towards both balance rings 360 and 362. It is noted that the balance rings 360 and 362 each have a radially-outward wall portion 376 having a through hole 378 and a longitudinally-outward wall portion 380 having a through hole 382. It is noted that the number, size, and location of through holes 382 may be chosen by the artisan to control the quantity of balancing material (i.e., wash water) 366 present in the balance rings 360 and 362 during the spin-dry cycle. It is further noted that the hole 378 preferably is a single hole which is indexed to be at the bottom of the balance rings 360 and 362 at the completion of the spin-dry cycle to drain the balance rings 360 and 362.

Figure 5:
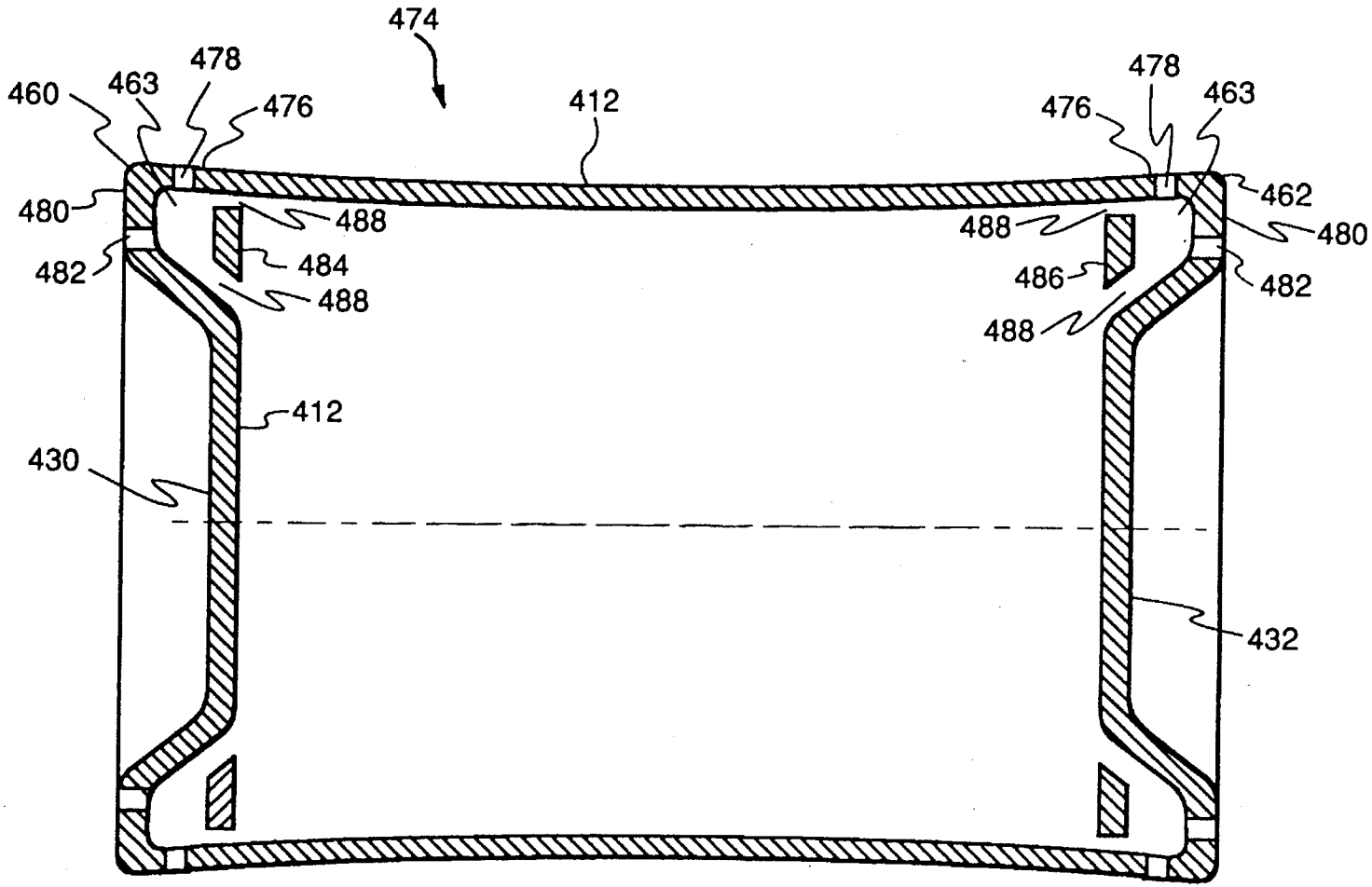
FIG. 5 is a schematic side-elevational view of a fourth preferred embodiment which is similar to that of FIG. 4 but also including a wall, having through holes, longitudinally dividing the balance ring from the clothes basket.

The rotatable subassembly 474 of FIG. 5 is generally identical to the rotatable subassembly 374 of FIG. 4, but rotatable subassembly 474 also includes a pair of walls 484 and 486 dividing a corresponding one of the cavities 463 of the balance rings 460 and 462 from the clothes basket 412 wherein the walls 484 and 486 each have through holes 488. As with rotatable subassembly 374 of FIG. 4, preferably rotatable subassembly 474 of FIG. 5 has its clothes basket 412 flared radially outward toward the ends 430 and 432 proximate the balance rings 460 and 462. It is likewise noted that the balance rings 460 and 462 each have a radially-outward wall portion 476 having a through hole 478 and a longitudinally-outward wall portion 480 having a through hole 482.

Figure 6:
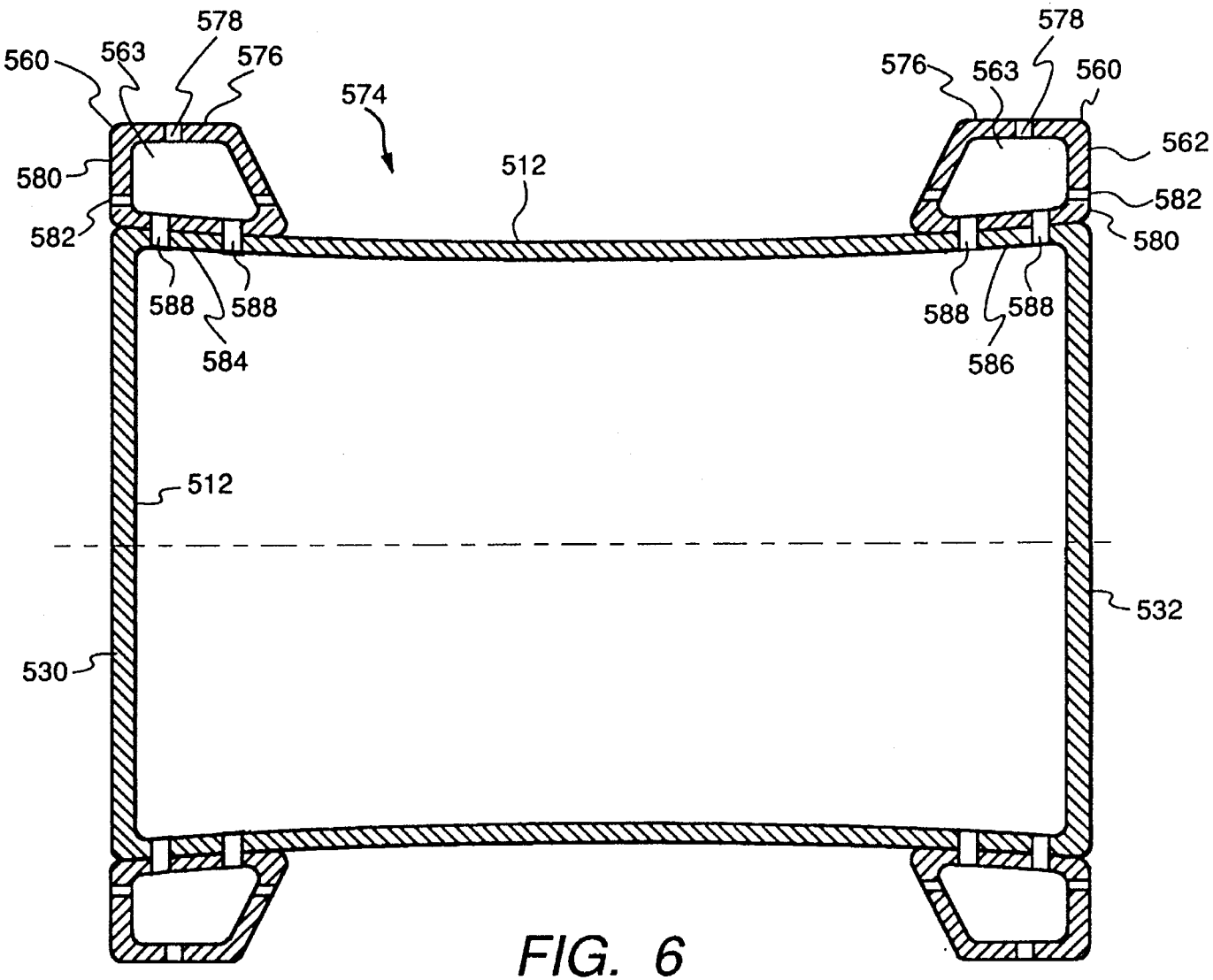
FIG. 6 is a schematic side-elevational view of a fifth preferred embodiment which is similar to that of FIG. 5 but with a radially-outwardly positioned balance ring.

The rotatable subassembly 574 of FIG. 6 is generally identical to the rotatable subassembly 374 of FIG. 4, but rotatable subassembly 574 has its balance rings 560 and 562 each extend radially outward of the clothes basket 512. Preferably, rotatable subassembly 574 also includes a pair of walls 584 and 586 radially dividing a corresponding one of the cavities 563 of the balance rings 560 and 562 from the clothes basket 512, wherein the walls 584 and 586 each have through holes 588. In an exemplary embodiment, the balance rings 560 and 562 are disposed at the ends 530 and 532 of the clothes basket 512. As with rotatable subassembly 374 of FIG. 4, preferably rotatable subassembly 574 of FIG. 6 has its clothes basket 512 flared radially outward toward the ends 530 and 532 proximate the balance rings 560 and 562. It is likewise noted tidal the balance rings 560 and 562 each have a radially-outward wall portion 576 having a through hole 578 and a longitudinally-outward wall portion 580 having a through hole 582.

In the broadest sense, as can be appreciated from the previously described embodiments, a balance ring of a horizontal axis clothes washing machine is a structure having a circumferential interior cavity which is either sealed or is in fluid communication with the cavity of another balance ring and/or the clothes basket and wherein at least one of the cavities of one of the balance rings is partially tilled with a balancing material at least when the load of clothes becomes unbalanced in the clothes basket during the spin-dry cycle. It is noted that, according to computer simulations, a horizontal axis clothes washing machine using the tub suspension of the invention alone, using one of the embodiments of the balance rings of the invention alone, or using the tub suspension and balance rings of the invention together will provide improved stability during the spin-dry cycle.

The foregoing description of a preferred embodiment of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

We claim:

1. A clothes washing machine comprising:

a) a rotatable clothes basket having a generally longitudinally extending and generally horizontally disposed axis of rotation;

b) a first member, said first member being a tub having a generally longitudinally extending axis generally coaxially aligned with said axis of rotation, said tub generally surrounding said clothes basket and said clothes basket rotatably attached to said tub;

c) a second member, said second member being a cabinet generally surrounding said tub;

d) a plurality of spaced-apart tub suspension subassemblies each including:

(1) a cylinder attached to one of said first and second members;

(2) a rod having a first end disposed within said cylinder and having a second end attached to the other of said first and second members, wherein one of said first and second ends of said rod is disposed closer to said axis of rotation than is the other of said first and second ends of said rod, wherein said one end is disposed longitudinally outward from said tub, and wherein said other end is disposed longitudinally outward from said one end;

(3) a piston disposed within said cylinder and attached to said first end of said rod; and (4) a spring disposed within said cylinder between said first and second ends of said rod, wherein said tub suspension subassemblies provide the only support and damping connection of said tub to said cabinet.

2. The clothes washing machine of claim 1, wherein said cylinder is pivotably attached to said one member.

3. The clothes washing machine of claim 2, wherein said cylinder includes an end having an aperture slidingly engaging said rod and wherein said cylinder is pivotably attached to said one member proximate said end of said cylinder.

4. The clothes washing machine of claim 3, wherein said second end of said rod is pivotably attached to said other member.

5. The clothes washing machine of claim 4, wherein said cabinet has two longitudinally spaced-apart ends and wherein said second end of said rod of one of said tub suspension subassemblies is attached to said cabinet proximate a corresponding one of said two longitudinally spaced-apart ends of said cabinet.

6. The clothes washing machine of claim 5, wherein said tub has two longitudinally spaced-apart ends and wherein said first end of said rod of said one tub suspension subassembly is disposed proximate a corresponding one of said two longitudinally spaced-apart ends of said tub.

7. The clothes washing machine of claim 1, wherein said second end of said rod is pivotably attached to said other member.

8. The clothes washing machine of claim 1, wherein said clothes basket has two longitudinally spaced-apart ends, and also including a pair of balance rings each having a circumferential interior cavity, each attached to said clothes basket proximate a corresponding one of said two longitudinally spaced-apart ends of said clothes basket, and each having a generally longitudinally extending axis generally coaxially aligned with said axis of rotation.

9. The clothes washing machine of claim 8, wherein said cavities of said balance rings are in fluid communication with each other.

10. The clothes washing machine of claim 9, wherein said cavities of said balance rings are abuttingly-open to said clothes basket.

* * * * *